US008678854B2

(12) United States Patent
Kalhoff

(10) Patent No.: US 8,678,854 B2
(45) Date of Patent: Mar. 25, 2014

(54) ELECTRICAL CONNECTOR FOR ACCOMMODATING AN ELECTRICAL CONDUCTOR AND IMPARTING SHAPE

(75) Inventor: Johannes Kalhoff, Blomberg (DE)

(73) Assignee: Phoenix Contact GmbH & Co. KG (DE)

( * ) Notice: Subject to any disclaimer, the term of this patent is extended or adjusted under 35 U.S.C. 154(b) by 555 days.

(21) Appl. No.: 12/933,353

(22) PCT Filed: Mar. 11, 2009

(86) PCT No.: PCT/EP2009/001723
§ 371 (c)(1), (2), (4) Date: Nov. 8, 2010

(87) PCT Pub. No.: WO2009/115218
PCT Pub. Date: Sep. 24, 2009

(65) Prior Publication Data
US 2011/0045710 A1 Feb. 24, 2011

(30) Foreign Application Priority Data
Mar. 18, 2008 (DE) ..... 10 2008 014 718

(51) Int. Cl.
*H01R 4/24* (2006.01)
*H01R 4/26* (2006.01)

(52) U.S. Cl.
USPC ..... 439/409; 439/592; 439/733.1; 439/931

(58) Field of Classification Search
None
See application file for complete search history.

(56) References Cited

U.S. PATENT DOCUMENTS

| | | | | |
|---|---|---|---|---|
| 3,818,420 | A | 6/1974 | Barr | |
| 4,284,312 | A | 8/1981 | Patchett et al. | |
| 4,341,430 | A * | 7/1982 | Crawford | 439/409 |
| 4,416,498 | A | 11/1983 | Sado et al. | |
| 4,430,777 | A * | 2/1984 | Takeda | 24/681 |
| 4,725,251 | A | 2/1988 | Neidecker et al. | |
| 4,963,700 | A | 10/1990 | Olsen et al. | |
| 4,995,829 | A * | 2/1991 | Geib et al. | 439/409 |
| 5,049,090 | A | 9/1991 | Johnson | |
| 5,145,381 | A | 9/1992 | Volz | |
| 5,188,539 | A * | 2/1993 | Langdon | 439/341 |

(Continued)

FOREIGN PATENT DOCUMENTS

| | | |
|---|---|---|
| DE | 3008110 A1 | 9/1980 |
| DE | 34 16 905 C1 | 1/1986 |

(Continued)

OTHER PUBLICATIONS

"Intenational Report on Patentability for International Application No. PCT/EP2009/001723", Jul. 8, 2010, Publisher: European Patent Office, Published in: DE.

(Continued)

*Primary Examiner* — Michael Zarroli
(74) *Attorney, Agent, or Firm* — Kaplan Breyer Schwarz & Ottesen, LLP

(57) ABSTRACT

The invention relates to an electrical connector for accommodating an electrical conductor or mating connector, having a first plastic section having a first degree of hardness or elasticity, and a second plastic section having a second degree of hardness or elasticity, wherein the first degree of hardness or elasticity and the second degree of hardness or elasticity are different, and the first plastic section cooperates with the second plastic section in order to accommodate the electrical conductor.

13 Claims, 22 Drawing Sheets

(56) References Cited

U.S. PATENT DOCUMENTS

| | | | | |
|---|---|---|---|---|
| 5,599,193 | A | 2/1997 | Crotzer | |
| 5,667,394 | A | 9/1997 | Chien | |
| 5,810,617 | A | 9/1998 | Hasagawa | |
| 6,152,760 | A * | 11/2000 | Reeser | 439/409 |
| 6,183,101 | B1 | 2/2001 | Chien | |
| 6,406,324 | B1 * | 6/2002 | Duesterhoeft et al. | 439/409 |
| 6,880,289 | B1 * | 4/2005 | Yin | 43/44.98 |

FOREIGN PATENT DOCUMENTS

| | | | |
|---|---|---|---|
| DE | 3524138 | A1 | 1/1987 |
| DE | 4000436 | A1 | 7/1990 |
| DE | 40 18 905 | A1 | 12/1991 |
| DE | 101 03 744 | C2 | 7/2002 |
| DE | 699 11 515 | T2 | 7/2004 |
| EP | 0339877 | A2 | 11/1989 |
| EP | 0402681 | A1 | 12/1990 |
| EP | 1829662 | A1 | 9/2007 |
| FR | 2554543 | A1 | 5/1985 |
| GB | 2069251 | A | 8/1981 |
| GB | 2161996 | A | 1/1986 |
| GB | 2342790 | A | 4/2000 |

OTHER PUBLICATIONS

"German Office Action for German International Application No. 10 2008 014 718.4-34", Dated: Jan. 22, 2009, Publisher: German Patent Office, Published in: DE.

Gramm, Lins & Partner GBR, "German Opposition for International Application No. 10 2008 014 718.4-34", Dated: Mar. 22, 2011, Publisher: Gramm, Lins & Partner GbR, Published in: DE.

* cited by examiner

Fig. 11

Locking the conductor
- Pressure from below
- Pressure from above
- Pressure from the side
- Pressure on both sides
- Pressure on all sides
- Partial pressure
- Surrounding pressure (sock effect, e.g.)
- xxx Locking the cable
See "Locking the conductor" and
- xxx Effects
- Cam
- Washboard
- Hydraulic
- Sock
- Membrane
- xxx Generation of pressure
- Parallel displacement
- Point-by-point extension of the material by
  - displacement of material
  - extension of material (thermal, etc.)
- xxx Generation of pressure against a clamping point
- Springing back:
  - WK is pushed in or relieved of pressure by B and allowed to spring back against clamping point
- Pressing:
  - WK is placed under pressure by B and pressed against clamping point
- Wedging:
  - B presses on clamping point via a wedge by displacement of WK (maintaining cam effect, e.g.)
- Twisting:
  - B twists WK and places clamping point under pressure (Geometric effect, e.g.)
- xxx

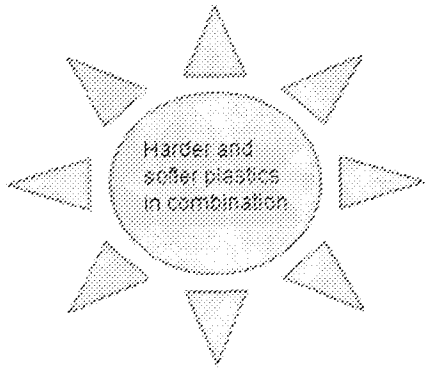

Combinations of functions
- Parallel displacement and generation of pressure
- Generation of pressure and closing/sealing
- Edging/cutting and connection
- Cable and sleeve as functional element (as a plug for the clamp)

Control element
- Actuator
- Releaser
- Actuator is also releaser
- Automatic actuation and manual release
- Manual release and automatic actuation
- Automatic actuation and release
- Embedding into the operation
- Locking
  - Automatic locking and release
  - Automatic locking
  - Automatic release
- xxx Opening a clamping point
- Springing back of material
- Targeted swiveling
- Geometric effect
- WK and HK may be interchanged
- HK loses its strength due to removal of support Tension-free clamping point
(Conductive plastic/clamping point without strain relief function)
- Conductive plastic "flows around" the conductor
- Brush contact (nanotubes)
- xxx WK: Soft plastic
HK: Hard plastic
LK: Conductor in clamp
B: Actuator
L: Releaser

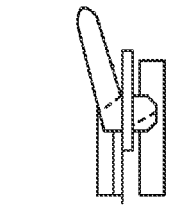
FIG. 14a
FIG. 14b
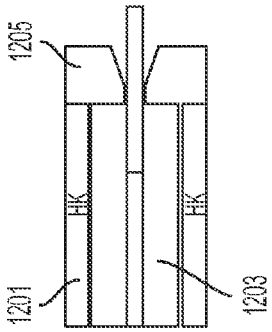
FIG. 12a
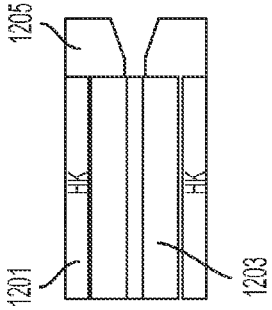
FIG. 12b
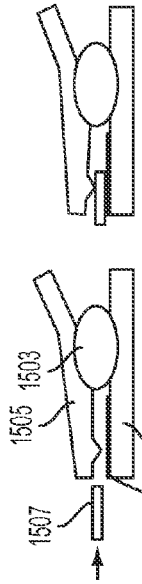
FIG. 15a
FIG. 15b
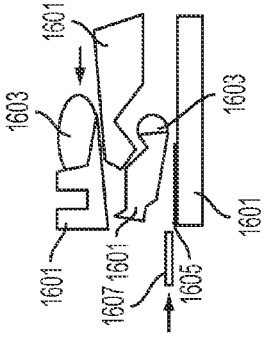
FIG. 16
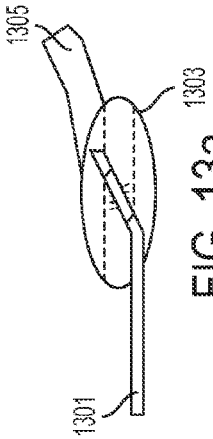
FIG. 13a
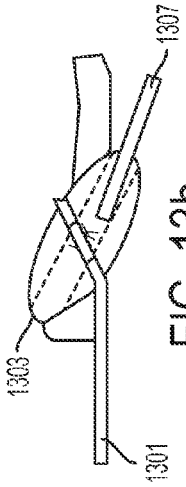
FIG. 13b
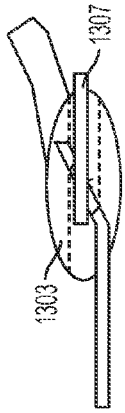
FIG. 13c

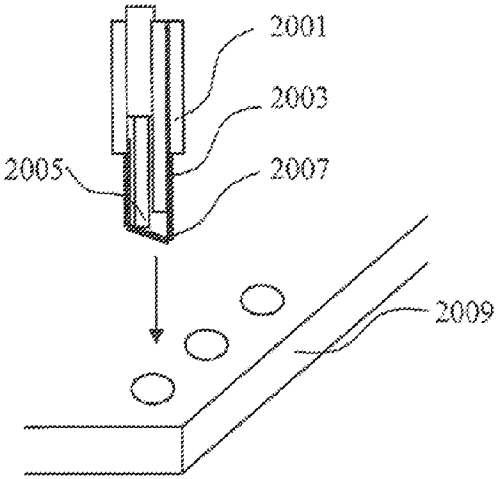
Fig.20
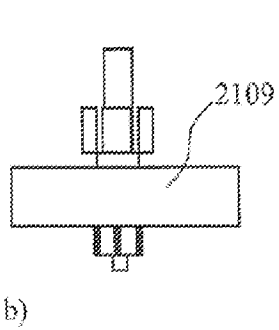
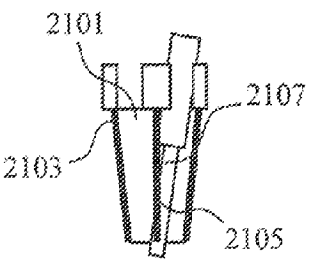
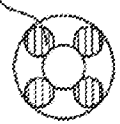
Fig.21
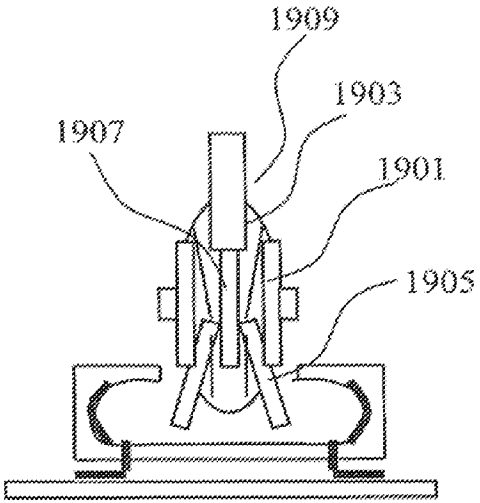
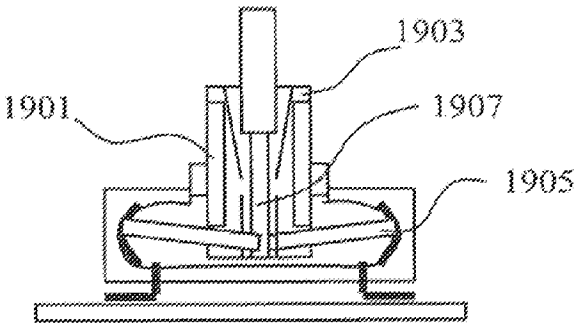
Fig.19

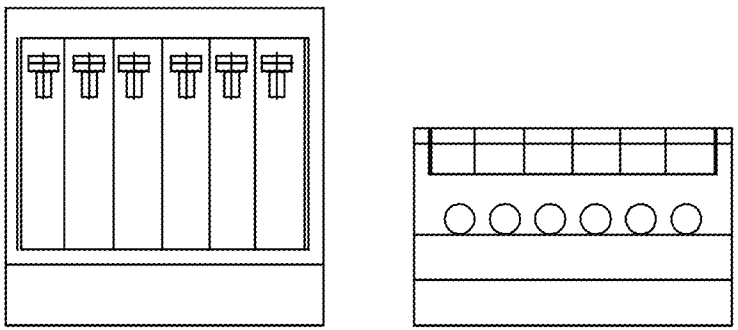
Fig. 29
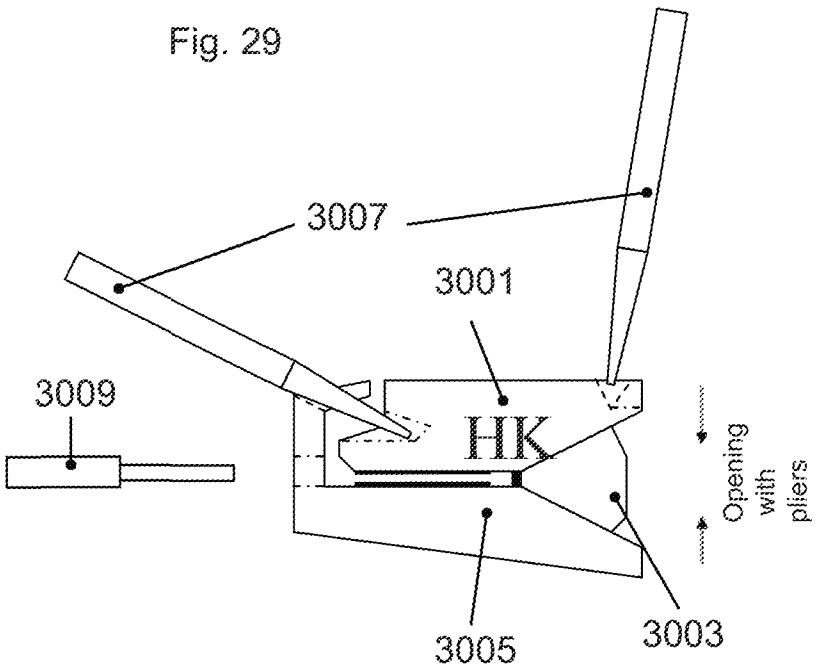
Fig. 30
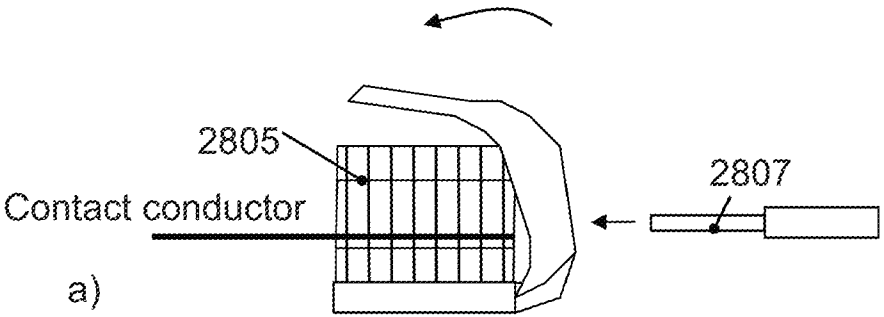
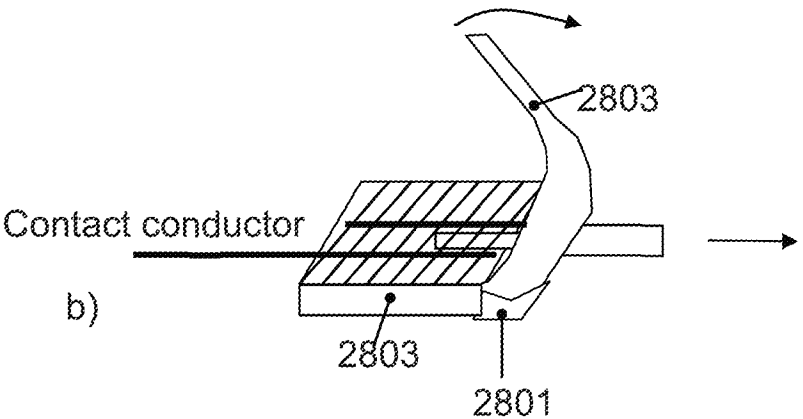
Fig. 28 a) State 1 b) State 2

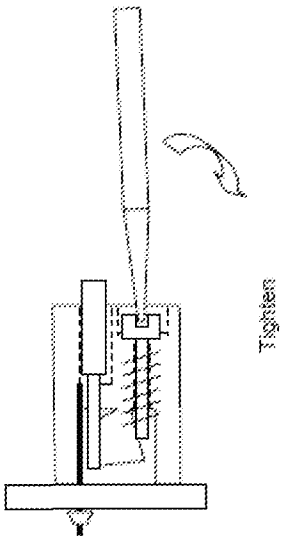
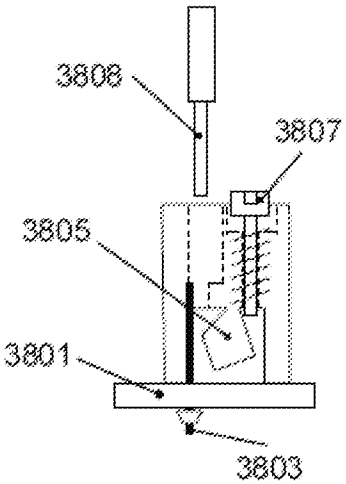
Fig. 38

ELECTRICAL CONNECTOR FOR ACCOMMODATING AN ELECTRICAL CONDUCTOR AND IMPARTING SHAPE

FIELD OF THE INVENTION

The present invention relates to the field of electrical connection technology.

BACKGROUND OF THE INVENTION

At the present time plugs, clamping points such as terminal blocks, for example, device connections, and all known electrical connections are implemented by mechanically locking a cable and electrically contacting a conductor using screw, spring, or displacement connections. In addition, electrically conductive metal in a plug may be replaced, for example, by a metal applied using molded interconnect device (MID) technology, thus reducing the number of plug components. Furthermore, by means of the plug-in connections, electrical conductors may be connected to one another using a socket and a plug. The electrical connection is thus established via an elastic contact, a housing being provided to ensure tightness of the plug. However, known electrical connectors are complex due to the fact that they are often composed of numerous different components.

SUMMARY OF THE INVENTION

The object of the invention is to provide a simple electrical connector.

The invention is based on the knowledge that a simple electrical connector, for example a plug-in connector or a clamp, may be implemented using at least two plastic sections, at least one of the plastic sections being elastic and reversibly deformable, for example, and the other plastic section, for example, imparting shape.

To allow integration density and handling of a connection using a plug, a detachable contact, or a fixed electrical connection to be significantly changed, according to the invention all components of such a connection are considered. This involves, for example, a contact to the conductor, locking of a cable, relaying of a contacted signal in the form of a current or a voltage, for example, taking into account a shield connection or an anti-kink protector, locking of the plug and the socket, tightness of the plug, the socket, and the cable, and the handling of these elements.

Mechanical springs may be replaced by use of the elastic plastic section, since a combination of a flexible plastic section, for contacting a conductor or mating connector, with a clamping element is employed without additional use of mechanical spring elements or clamping parts due to use of the soft, i.e., elastic, plastic sections in combination with shape-imparting hard plastic sections. The combination of flexible plastic sections and sections of a mechanically harder material also facilitates releasability of the connection in addition to mechanical stability. The differing degrees of hardness or elasticity of the plastic sections may be based on the use of different plastics and/or different geometries and shapes of the sections, even when the same plastics are used. In the following description the term "soft plastic" is used to denote a plastic section which has a lesser degree of hardness than a "hard plastic section," and vice versa.

According to a further embodiment of the invention, the plastic sections may be conductive and may be used in a connecting point. For example, the plastic surfaces are conductive. The contacting of electrical conductors may be replaced, for example, by a soft embedded plastic having a conductive material or having a conductive support material with metals, for example, mounted thereon, or with electroplated plastic, or by conductive plastics, which is also possible for the less elastic, harder plastic having a conductive surface. This combination is advantageous in particular for the further miniaturization of the clamping elements. For example, by using a conductive plastic which is manufactured with the aid of so-called nanotubes, the contact to the conductor may be provided with a large surface, since a contact surface corresponds to the entire end of the conductor, and the locking may be performed using a separate locking technology. Thus, the construction and design of the clamp may be more flexible.

According to the invention, complex, compact structures and connectors may be economically and efficiently extruded or provided with a simple mechanical design. The concept according to the invention allows a higher degree of complexity in the clamping mechanics due to the fact that a larger number of movable, and also smaller, parts are possible which, however, do not have the disadvantage of being composed of numerous components. The mechanics may be provided, for example, as an injection-molded part assembled using a placement function, and which in a further injection molding process is enclosed by softer plastic and therefore has a functional composition. This results in simpler handling of the products for electrically and mechanically contacting conductors and cables. The concept according to the invention also allows manufacture of new types of plugs and contacts, for example printed circuit board connectors, or development of alternative connection methods. The functioning of the electrical connector is simplified as a result of the mechanically cohesive design of the plastic sections using elastic, soft plastic. The haptics are improved due to the design using soft or shape-imparting plastics. This applies not only for operating the control elements, but also for the assistance of functions, for example reducing the tendency for installed cables or two paired connectors to slip out. The concept also allows production of simple and complex mechanical structures using the injection molding process, for example. Furthermore, the electrical connector may be completely implemented without metal components. The elastic, soft plastics may be manufactured with the aid of plastic softeners, for example.

The invention relates to electrical connectors for accommodating an electrical conductor or mating connector, having a first section which includes a plastic and which has a first degree of hardness or elasticity, and a second section which includes a plastic and which has a second degree of hardness or elasticity, the first degree of hardness or elasticity and the second degree of hardness or elasticity being different, and the first section cooperating with the second section in order to accommodate the electrical conductor or mating connector.

According to one embodiment, the first section and/or the second section, or only the second section, is/are reversibly deformable.

According to one embodiment, the first section and/or the second section is/are conductive.

According to one embodiment, the first section and/or the second section is/are elastically deformable, and the electrical conductor or mating connector may be accommodated by deforming the first section or the second section.

According to one embodiment, the electrical connector also includes a third section which includes a plastic having the first degree of hardness or elasticity, wherein the second section connects the first section and the third section, and the first section may be displaced or twisted relative to the third section with deformation of the second section, and may be locked and preferably released by displacement or twisting.

According to one embodiment, the first section may be inserted into the second section, and may be locked therein and preferably released by elastic deformation of the first section or of the second section.

According to one embodiment, the first section may be twisted relative to the second section, or the second section may be twisted relative to the first section, wherein the first section or the second section may be locked and preferably released by twisting.

According to one embodiment, the second degree of elasticity is greater than the first degree of elasticity, or the first degree of hardness is greater than the second degree of hardness.

According to one embodiment, the second section is provided for accommodating the electrical conductor or mating connector, the first section imparting shape and at least partially enveloping the second section.

According to one embodiment, the second section includes comb-shaped regions for accommodating the electrical contact or mating connector.

According to one embodiment, the second section is designed as an elastic clamping connector.

According to one embodiment, the electrical connector also includes a third section having the first degree of hardness or elasticity, wherein the first section may be clamped in a recess in the third section, and may be released as the result of a restoring force of the second section.

According to one embodiment, the electrical connector also includes a third section having the first degree of hardness or elasticity, the first section and the third section being connected by the second section and forming a clamp.

According to one embodiment, the electrical connector also includes a third section having the first degree of hardness or elasticity, and which is displaceably supported with respect to the first section.

According to one embodiment, the second section includes an elastic bead, the first section having a cross section which is rotatably situated about the second section in order to deform or release the elastic snap bead for locking the electrical conductor or mating connector.

BRIEF DESCRIPTION OF THE DRAWINGS

Further exemplary embodiments are explained in greater detail with reference to the accompanying drawings, which show the following:

FIG. 11 shows a morphological box;
FIG. 12 shows an electrical connector;
FIG. 13 shows an electrical connector;
FIG. 14 shows an electrical connector;
FIG. 15 shows an electrical connector;
FIG. 16 shows an electrical connector;
FIG. 19 shows an electrical connector;
FIG. 20 shows an electrical connector;
FIG. 21 shows an electrical connector;
FIG. 28 shows forms of clamps;
FIG. 29 shows further forms of clamps;
FIG. 30 shows a clamp;
FIG. 38 shows a further form of clamp.

DETAILED DESCRIPTION

Figure 1:
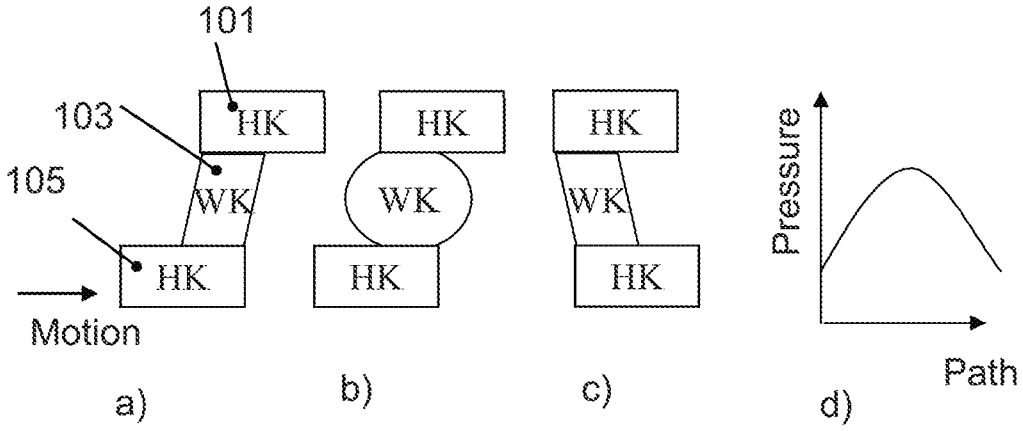
FIG. 1 shows an electrical connector.

FIG. 1*a* shows an electrical connector having a first section 101, a second section 103, and a third section 105. The second section 103 elastically connects sections 101 and 105, and is preferably reversibly deformable. If, for example, the third section 105 is moved laterally relative to the first section 101, the second section 103 is deformed as illustrated in FIG. 1*b*. When the first section 101 moves further relative to the third section 105, the built-up pressure in the elastic plastic section 103 is reduced, resulting in a locked state illustrated in FIG. 1*c*. FIG. 1*d* shows the resulting variation of pressure over time in the second section 103. Use is made of the so-called "cam effect" in the plug-in connector illustrated in FIG. 1. Sections 101, 103, and 105 are made of or preferably include a plastic, second section 103 being more elastic than first section 101 and third section 105. The second section may also be made of soft plastic, whereby the first and the third section, 101 and 105, respectively, may be made of hard plastic.

Figure 2:
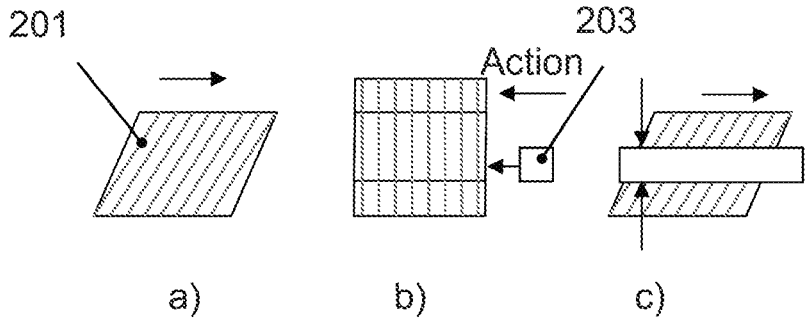
FIG. 2 shows an electrical connector.

FIG. 2 shows an electrical plug-in connector having a deformable plastic section 201 into which a further plastic section 203 may be inserted, thus establishing a connection by making use of the "sock effect." FIGS. 2*a* through 2*c* illustrate the state transitions when plastic section 203 is inserted into plastic section 201.

Figure 3:
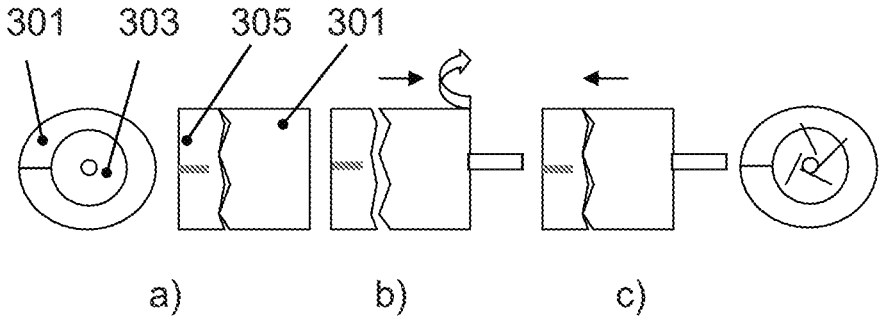
FIG. 3 shows an electrical connector.

FIG. 3 shows an electrical plug-in connector in which use is made of a torsion effect for producing a locked state. The combination of flexible plastic in the clamp is also used to achieve a surrounding seal and strain relief. This connection also allows simpler manufacturing processes in which, for example, hard plastics or metals are extrusion coated. The electrical connector illustrated in FIG. 3 includes a first section 301, a second section 303, and a third section 305, the second section 303 being elastic and made of plastic, for example. When sections 301 and 305 are twisted relative to one another, the teeth illustrated in FIG. 3 intermesh, resulting in a lock. The lock is released, for example, by pulling apart sections 301 and 305, thus releasing the teeth.

Figure 4:
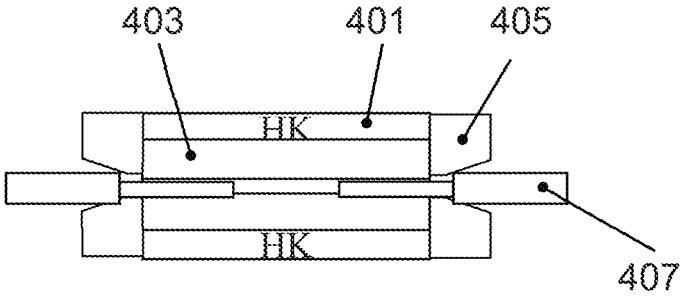
FIG. 4 shows an electrical connector.

FIG. 4 shows an electrical connector having a first section 401 which envelops a second section 403. Side pieces 405 are also provided. The first section 401 is less elastic than the second section 403, and imparts a stable shape. The electrical connection is established when an electrical connection 407, for example a conductor, is pushed into the electrical connector and is clamped by the second section, thus making use of the so-called "flow-around" effect. This flow-around effect is particularly effective for electrically conductive materials.

Figure 5:
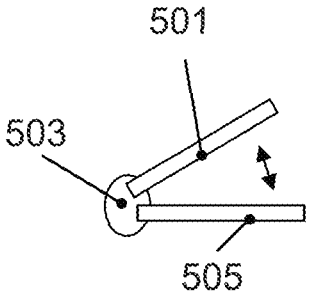
FIG. 5 shows an electrical connector.

FIG. 5 shows an electrical connector having a first section 501, a second section 503, and a third section 505. The second section 503 is more elastic than the plastic sections 501 and 505, and pulls sections 501 and 505 together in the manner of a hinge, for example, to establish the electrical connection.

Figure 6:
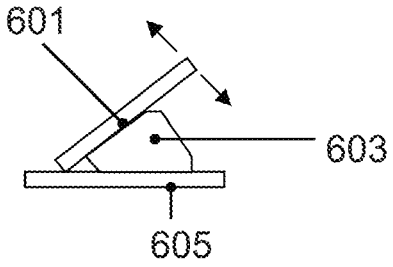
FIG. 6 shows an electrical connector.

FIG. 6 shows an electrical connector having a first section 601, a second section 603, and a third section 605. Sections 601, 603, and 605 include plastics, section 603 being more elastic than the other two sections, so that when the first section 601 is actuated in the direction of the illustrated arrows, an end of the first section 601 which faces third section 605 may be moved back and forth toward and away from same, thus establishing an electrical clamping connection which makes use of the so-called "holding effect."

Figure 7:
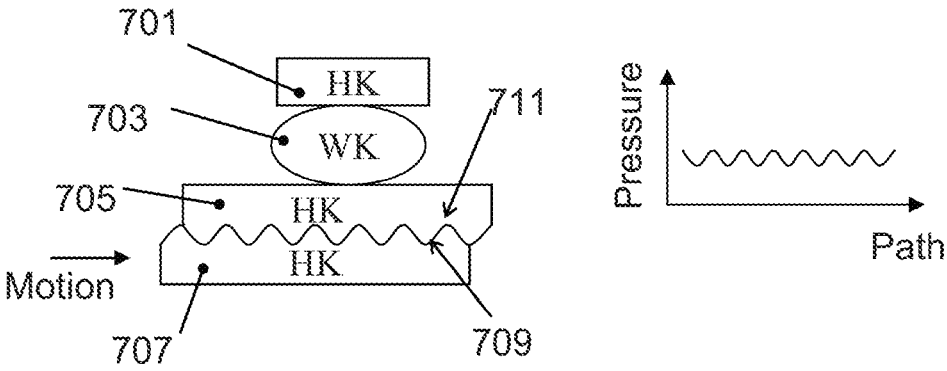
FIG. 7 shows an electrical connector.

FIG. 7 shows an electrical connector having a first section 701, a second section 703, a third section 705, and a fourth section 707. Sections 701, 705, and 707 are made, for example, of a plastic having lower elasticity than section 703. Sections 701, 705, and 707 may also be made of harder plastic (HK) than section 703, which may be made of softer plastic (WK). Plastic sections 705 and 707 are also provided with washboard-like mutually facing surfaces 711 and 709, respectively, which interlock when sections 705 and 707 move laterally relative to one another, as illustrated in FIG. 7. The variation of pressure over time in the second section 703 is plotted as a function of time in the pressure diagram, likewise illustrated in FIG. 7.

Figure 8:
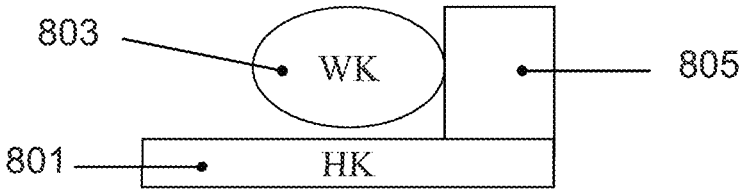
FIG. 8 shows an electrical connector.

FIG. 8 shows an electrical connector having a first section 801, a second section 803, and a side section 805. The first section 801 is, for example, a harder plastic section than the second section 803. In the electrical connector illustrated in FIG. 8 use is made of the hydraulic effect, according to which the second, elastic section 803 is vertically deformed when acted on by lateral force.

Figure 9:
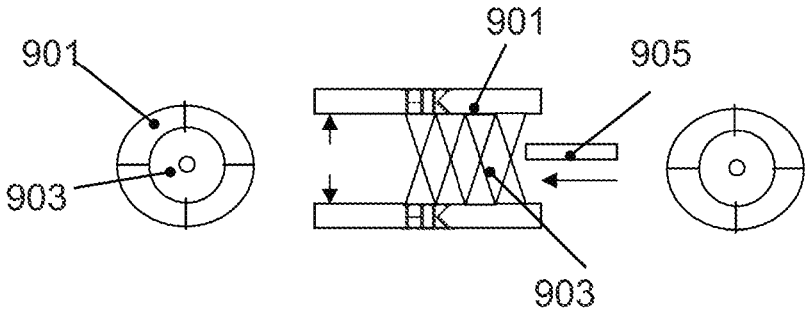
FIG. 9 shows an electrical connector.

FIG. 9 shows an electrical connector having a first section 901, which may have a cylindrical or sleeve-shaped design, for example, second sections 903 being provided between the inner sides of the first section. An electrical contact 905 may, for example, be inserted into the electrical connector, and due to the elasticity of the second sections 903 may be clamped and secured in place. The second sections 903 may also be used for sealing.

Figure 10:
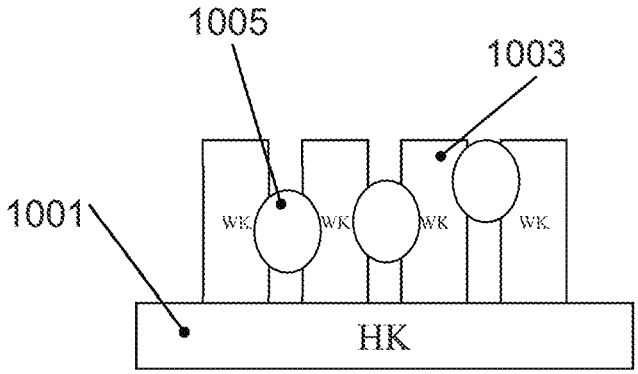
FIG. 10 shows an electrical connector.

FIG. 10 shows an electrical connector having a first section 1001, and second sections 1003 having a comb-shaped design. Spacers 1005 are also provided. The comb of the soft plastic sections supports the installation and fastening of a cable before the actual locking, whereby strain relief or sealing may also be achieved by pressing on a mating part.

FIG. 11 shows a morphological box having an association of the soft plastics (WK) or plastic sections, and the hard plastics (HK) or plastic sections, with the respective connector functionality.

FIG. 12*a* shows an electrical connector having a first plastic section 1201 provided in the form of a sleeve and made of hard plastic, for example, and which envelops a second section 1203. Side pieces 1205 are also provided. The second section 1203 is conductive and flexible, for example, and includes a central alignment hole into which an electrical cable may be inserted, as illustrated in FIG. 12*b*.

FIG. 13*a* shows an electrical connector having a first section 1301, a second section 1303 which is more elastic than the first section 1301, and a lever piece 1305. As illustrated in FIG. 13*b*, a conductor 1307 is inserted into the second section 1303 when the lever piece 1305 is actuated downwardly. When the lever piece 1305 is released, the soft plastic 1303 springs back to its neutral position and clamps the conductor 1307 against the clamping points.

FIG. 14 shows an electrical connector having a first section 1401, an elastic second section 1403, a third section 1405, and a fourth section 1407 designed in the manner of a lever. When the lever-like fourth section 1407 is actuated a conductor may be horizontally inserted into the connector; when the lever piece 1407 is actuated, its bead section engages with a recess in the section 1401, thus locking the conductor. Use is thus made of the so-called "geometric effect."

FIG. 15 shows an electrical connector having a first section 1501, a second section 1503 which is elastic, and a third section 1505 which, like section 1501, is less elastic than section 1503. An elastic section 1505 [sic; 1506] may also be provided on a surface of section 1501. Sections 1501 and 1505 are connected by the more elastic plastic section 1503, as the result of which a conductor 1507 may be inserted and clamped by making use of the rocker effect, as illustrated in FIGS. 15*a* and 15*b*.

FIG. 16 shows an electrical connector having first plastic sections 1601 and second plastic sections 1603, which are elastic. A further elastic section 1605 may also be provided. When a conductor 1607 is inserted in the direction indicated by the arrow, as illustrated in FIG. 7*a* [sic; 16*a*], the electrical connector is closed, and in the closed state assumes the shape illustrated in FIG. 16*b*. Use is thus made of the so-called "trap effect."

Figure 17:
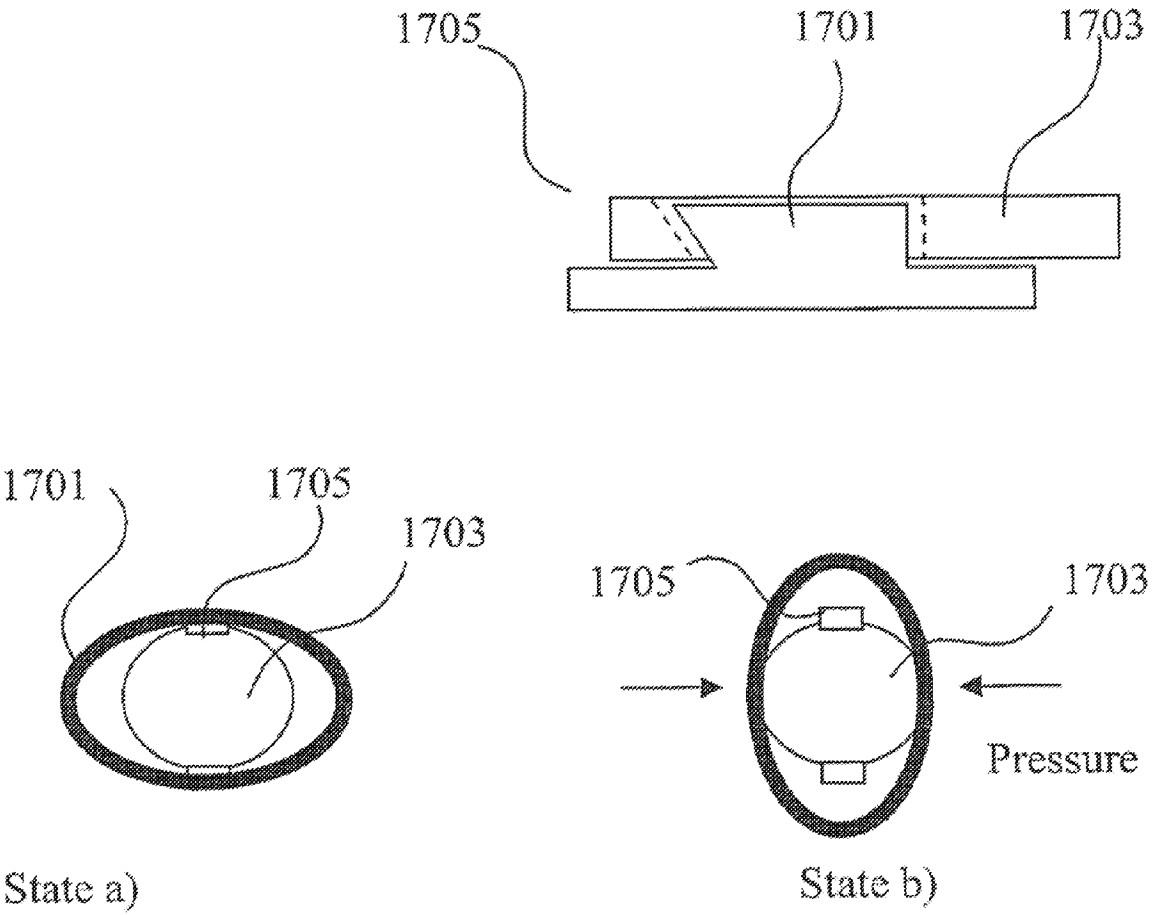
FIG. 17 shows an electrical connector.

FIG. 17 shows an electrical connector having a first section 1701 which has an ellipsoidal cross section, and a second section 1703 situated therein which has bead or tab sections 1705. The second section 1703 forms a socket, for example, and the first section 1701 is a plug, for example. The beads 1705 are released by twisting the first section 1701. The beads 1705 may be shaped in the form of locking tabs, for example, as illustrated in FIG. 17. Use is thus made of the so-called "deformation effect."

Figure 18:
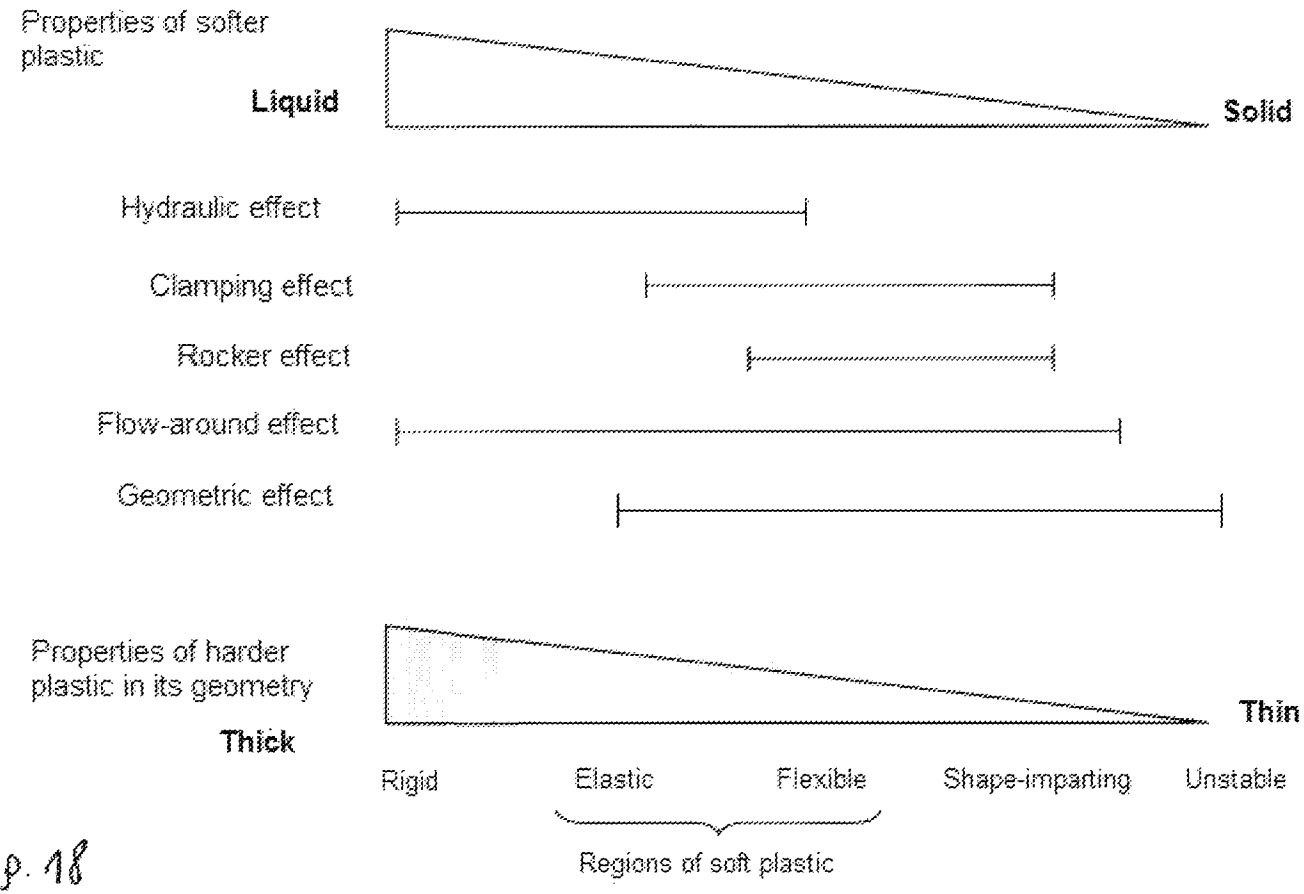
FIG. 18 shows an association of the plastic properties with the respective connector functionality.

FIG. 18 illustrates the association of the properties embodied by the plastic sections with the respective functionality of the electrical connector according to the invention.

FIG. 19 shows an electrical connector having a first section 1901 in the form of a rigid plastic plug, an elastic second section 1903, and a plug contact 1905 designed, for example, as a metal contact to the conductor 1907 and as a spring element for locking. The conductor 1907 is inserted into an insertion guide 1909 as illustrated in FIG. 19*a*. As illustrated in FIG. 19*b*, the soft plastic 1903 locks the conductor 1907, with deformation. The connector illustrated in FIG. 19 may be used as an SMD printed circuit board connector, for example.

FIG. 20 shows an electrical connector having a first section 2001 in the form of a rigid plastic plug, and having a second section 2003 which locks a conductor 2005 and exerts a spring effect on a clamping point 2007, which may form a spring contact, for example. The electrical connector may be inserted into an opening in a printed circuit board 2009, as illustrated in FIG. 20.

FIG. 21 shows an electrical connector having a soft, conductive plastic section 2101 which locks a conductor 2107 and produces a spring effect on a clamping point 2105, as illustrated in FIG. 21*a*, and having harder plastic sections 2103. FIG. 21*b* shows the electrical connector from FIG. 21*a* during insertion into a printed circuit board 2109. FIG. 21*c* shows the electrical connector in cross section together with the rigid plastic sections 2103, which may be inserted as a plug and runner for plugging in.

Figure 22:
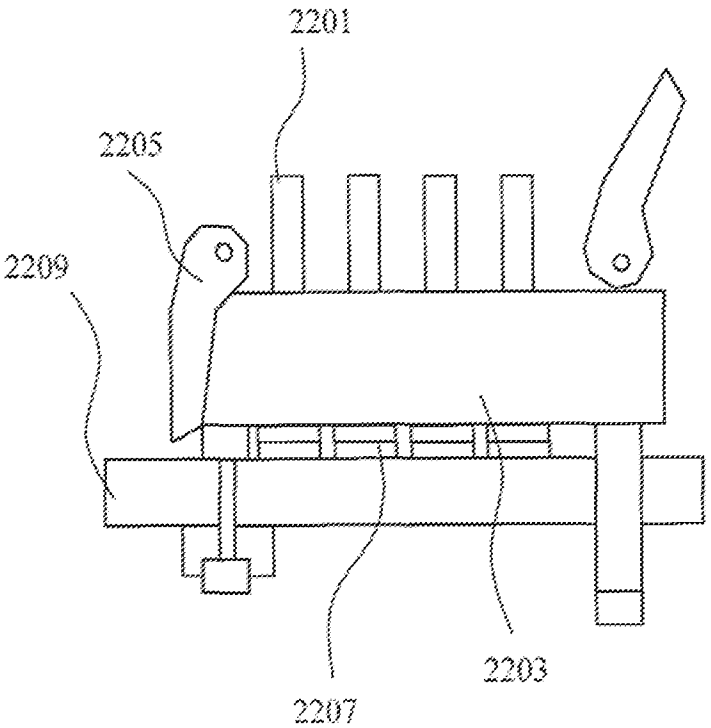
FIG. 22 shows an electrical connector.

FIG. 22 shows an electrical connector having conductors 2201 to be contacted, a plug element 2203, and a tension pin 2205 for a harder plastic section, which for example compresses a flexible portion of a bolt and fastens the printed circuit board connector. Connections 2207 to contacts for the printed circuit board 2209 may be established in this manner. In particular, contacts on both sides or conductor tracks for contacts, or also conductor tracks as defined contacts, may be produced. It is advantageous that the printed circuit boards may merely have standard boreholes, and the contacts may be easily mounted using SMD technology, or may be produced by a printed circuit board manufacturer, for example by processing the conductor track. The connector 2207 may also be part of a tension pin 2205.

Figure 23:
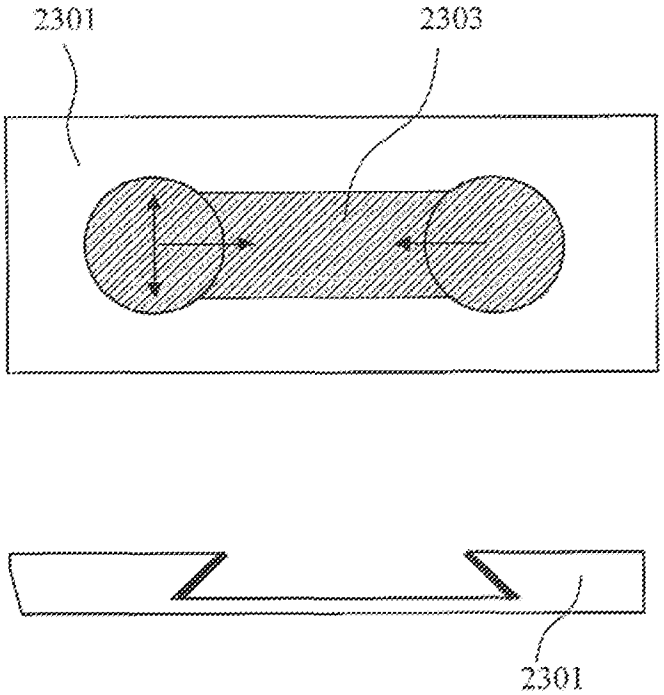
FIG. 23 shows a configuration of plastics.

FIG. 23 shows a configuration of rigid plastic sections 2301 and elastic plastic sections 2303 which may interact with one another for a lockable connection.

Figure 24:
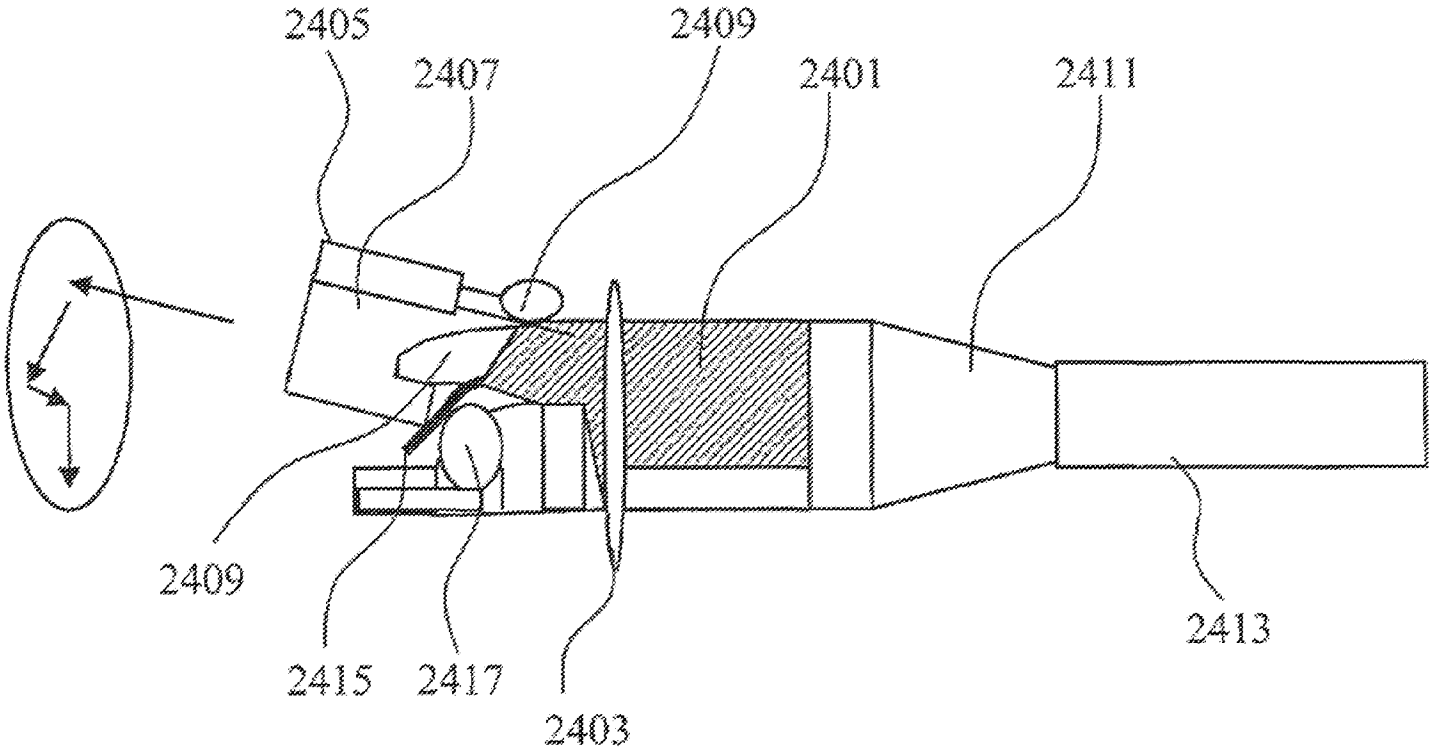
FIG. 24 shows an electrical connector.

FIG. 24 shows an electrical connector having an elastic plastic 2401 which may also be conductive. Also provided are an extrusion coating 2403 which provides a seal, and a movable element 2405 which provides a catch lock with the hard plastic 2407 and soft plastic 2409. A strain relief and sealing section 2411 is also provided, the strain relief and sealing being achieved via the sock effect when the plug is latched, whereby the strain relief seals the plug so that after latching, the plug is sealed due to the flexibility of the plastic 2401. A network cable 2413 is introduced into the electrical connector, and the internal conductor 2415 of the network cable is situated in the cutting edge and contact region 2417.

The motion to be carried out for locking the internal conductor 2415 is illustrated in FIG. 24 by the arrow system, whereby the leads may be cut by pulling and latching. The vertical motion of the catch lock 2405 is carried out to avoid the cut edge connections from coming loose when the plug is pulled. The internal conductor 2415 rests in guides and may be shortened at any time.

Figure 27:
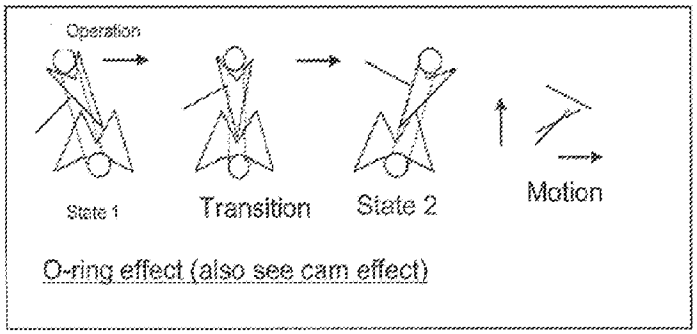
FIG. 27 shows a connector operation.
Figure 26:
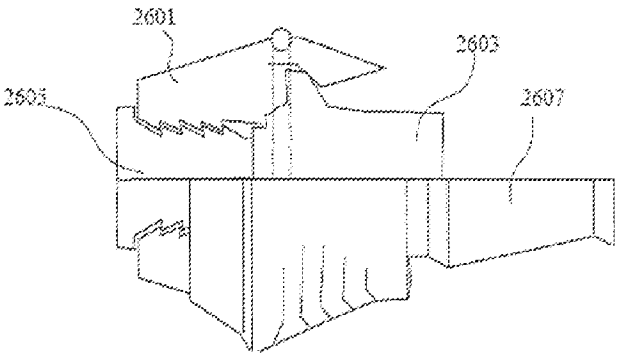
FIG. 26 shows an electrical connector.
Figure 26:
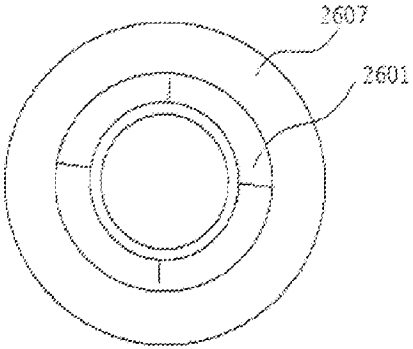
Figure 25:
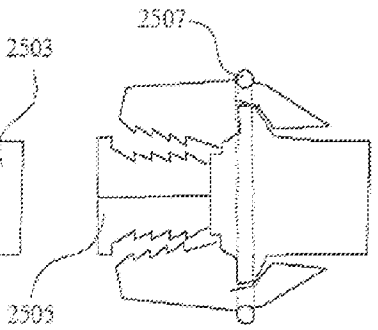
FIG. 25 shows an electrical connector.

FIGS. 25 through 27 show utilization of the cam effect with the aid of an O-ring on a connector for accommodating a mating connector.

FIG. 25 shows an electrical connector having harder plastic sections 2501 in the form of tooth-like clamps, which are pivotable about a pivot point of a connector element 2503 and are connected to this connector element 2503. For this purpose, a softer plastic section 2507 in the form of an O-ring is guided around the connecting element 2503, the O-ring being fixedly mounted on the clamps 2501 near a pivot point of the connector element 2503. When the clamps swivel, the O-ring 2507 crosses the pivot point of the connector element 2503, so that the clamps are releasably fixed in either an open position ready for accommodation (FIG. 25*a*) or a closed position (FIG. 25*c*). When a mating connector 2505 is inserted which has an outer design which at least partially corresponds to the tooth-like clamps, the toothed sections illustrated in FIG. 25 intermesh, resulting in the connection illustrated in FIG. 25*c*. In addition, the softer plastic section 2507 for pressing clamps 2501 together or holding them open may be part of an outer casing of the connector element 2503.

FIG. 26*a* shows an electrical connector similar to that of FIG. 25, having a pivotable harder plastic section 2601, a connector element 2603, and a flexible casing 2607 which integrates the softer plastic section for pressing clamps 2601 together or holding them open, making use of the cam effect for accommodating or releasing a mating connector 2605. FIG. 26*b* shows the conductor from FIG. 26*a* in cross section.

FIG. 27 clarifies the operation of the plugs illustrated in FIGS. 25 and 26, which operate according to the O-ring effect or the cam effect.

FIGS. 28*a* and b show possible states of forms of clamps which make use of the previously described sock effect. A pivotable lever mechanism is achieved by using elastic sections 2801 and less elastic sections 2803. Between the sections 2803 which define the lever arms, a further deformable plastic section 2805 is held which defines an accommodation space in which a contact conductor is situated. According to FIG. 28*a*, a conductor 2807 is inserted from the side of the lever mechanism and into the opened accommodation space of the deformable plastic section 2805. By swiveling (FIG. 28*b*) at least one lever arm in the direction opposite to the insertion direction of the conductor 2807, the plastic section 2805 is compressed, the accommodation space is closed, and the conductor 2807 is clamped on the contact conductor. In this state the conductor 2807 remains captive on the contact conductor, even under tensile stress. Additional introduction of harder plastic into the deformable plastic section 2805 may further intensify the holding effect under tensile stress. The action of pressure on the plastic section 2805 is ended, and the conductor 2807 is removable, only when at least one lever arm is swiveled in the direction of the insertion direction, i.e., into the starting position according to FIG. 28*a*.

FIG. 29 schematically shows from front to rear another form of clamp, for example in the form of a large clamp, which may be extruded as one piece, so that an active element acts jointly on all clamping points. Alternatively, an individual active element may be provided for each clamping point.

FIG. 30 shows a schematic side view of a clamp/active element similar to that of FIG. 29, having a first section 3001, a second section 3003, and a third section 3005. Sections 3001 and 3005 are less elastic than section 3003, and are made of hard plastic, for example. These sections may also be produced using MID technology, or may be made partly of metal. The clamp may be opened by inserting pliers, for example, and a conductor 3009 is inserted by means of a rocker effect, for example. Thus, the more elastic plastic section 1503 [sic; 3003] is once again preferably situated between sections 3001 and 3005, similar to the principle described with reference to FIG. 15, to enable the rocker effect. In addition, a pin-like tool 3007 such as a screwdriver 3007, for example, which is inserted in one of the two approach positions shown in FIG. 30 is basically sufficient to insert and clamp a conductor 3009, making use of the rocker effect.

Figure 31:
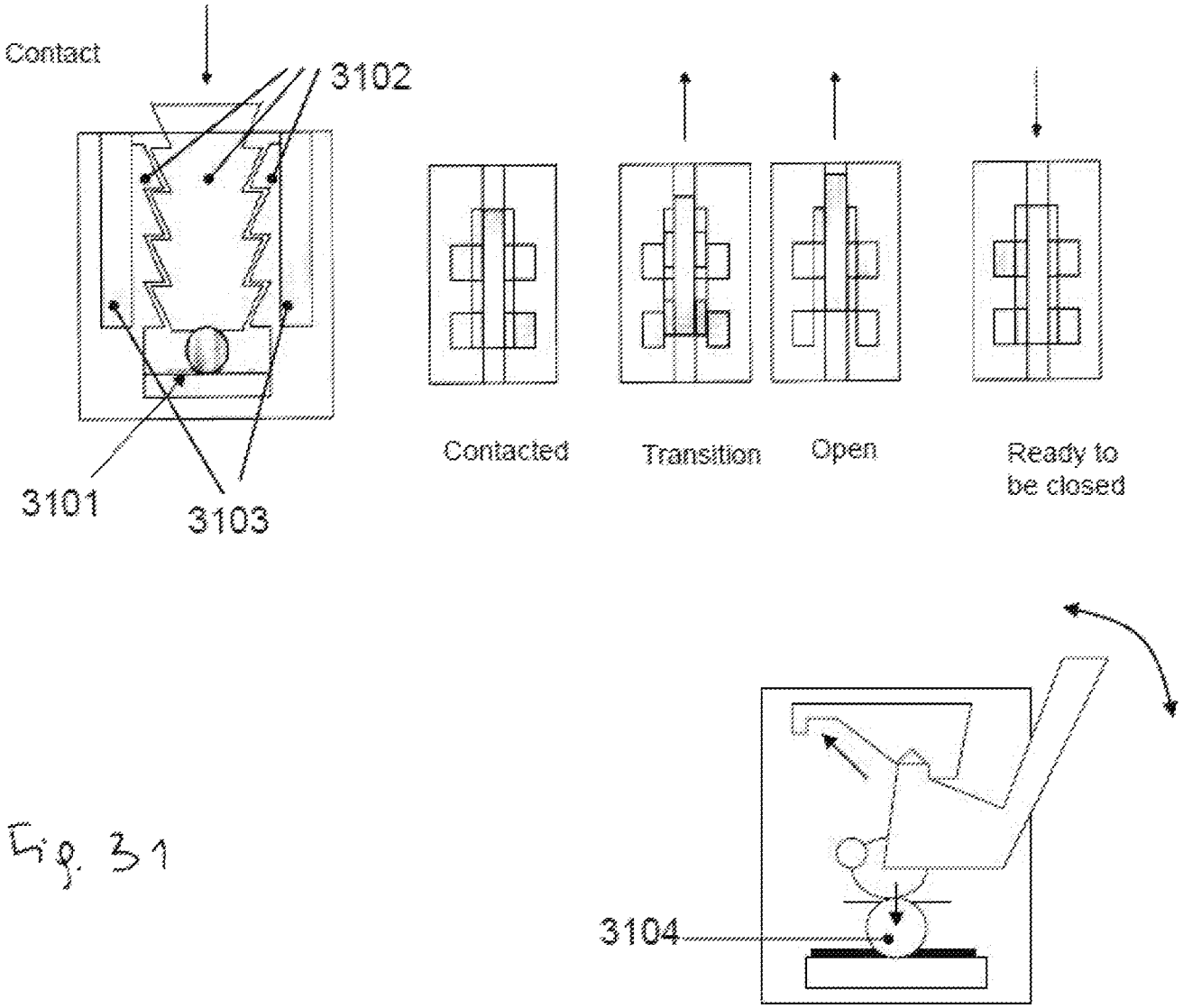
FIG. 31 shows further forms of clamps.

FIG. 31 schematically shows further forms of clamps, whereby a catch mechanism 3102 formed from harder plastic sections, for example, is supported between softer plastic sections 3103 in order to accommodate a conductor 3101. A catch lock may also be produced as a mechanical cam controller, for example, and a rocker mechanism may also be used for clamp-like locking of a conductor 3104.

Figure 32:
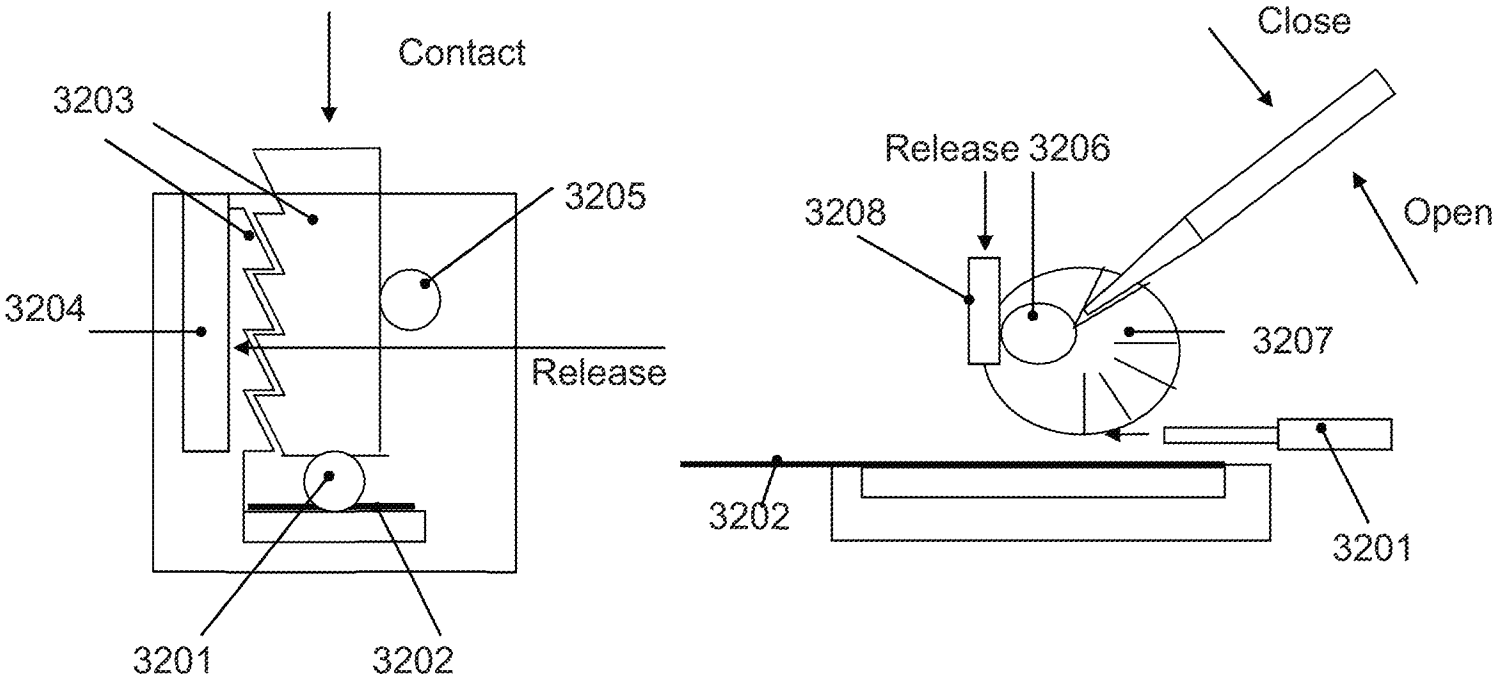
FIG. 32 shows further forms of clamps.

Two further forms of clamps are illustrated in FIG. 32. The left illustration in FIG. 32 shows a conductor 3201 to be accommodated, which is to be electrically connected to a conductive contact section 3202 situated in the connector. A catch mechanism 3203 formed from harder plastic sections is supported on only one side on a softer plastic section 3204, which must be pressed in the opposite direction to be released. A significantly harder contact or support section 3205 is situated on the opposite side from the softer plastic section 3204.

The right illustration in FIG. 32 shows a form of clamp in which a conductor 3201 to be accommodated, which is to be electrically connected to a conductive contact section 3202 situated in the connector, is clamped at the contact site by swiveling a harder plastic section 3207 about a softer plastic section 3206 in the direction of the conductor 3201, using a pin-like tool, i.e., actuator, and closing the receiving opening by pressing the softer plastic section 3206 using the harder plastic section 3207. The catch lock of the hard plastic section 3207 engages with the catch lock of the surrounding hard plastic housing. The catch lock is similar to the operating principle for the left illustration in FIG. 32; in the present case the motion is circular, not linear. For opening, the pin-like tool is moved in the opposite direction. For releasing the conductor 3201, depending on the strength requirements of the catch lock a second, for example wedge-shaped, harder section 3208 may also move apart the catch lock between the housing and the harder plastic section 3207, using a tool to be applied.

Figure 34:
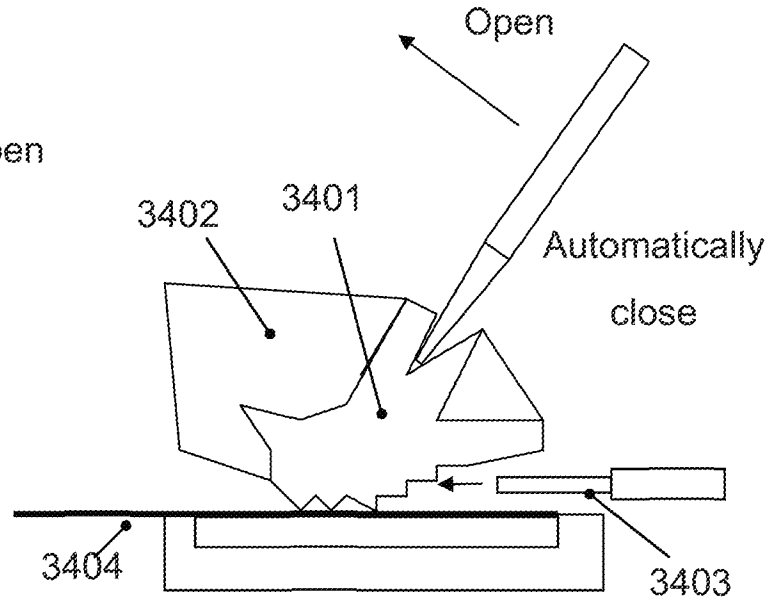
FIG. 34 shows further forms of clamps.
Figure 33:
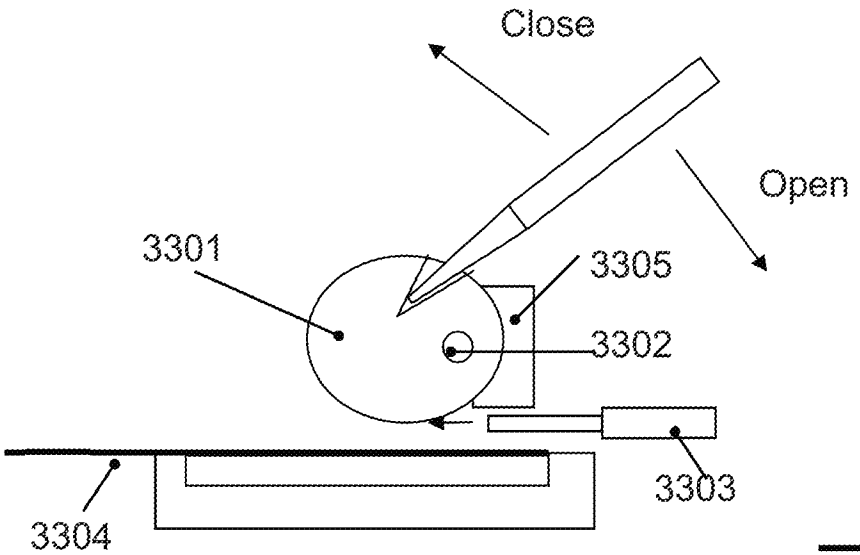
FIG. 33 shows further forms of clamps.

Further forms of clamps are illustrated in FIGS. 33 and 34.

In FIG. 33 the plastic sections of the clamp form are configured in such a way that a softer plastic section 3301 is swiveled about an off-center swivel axis 3302 for opening or closing in order to press an inserted conductor 3303 against a contact conductor 3304 situated in the connector, in the closed state. The pivotable plastic section 3301 is also supported against a harder plastic section 3305, which in the illustrated configuration also prevents the conductor 3303 from being inadvertently pulled out.

In FIG. 34 the plastic sections of the clamp form are configured in such a way that a harder plastic section 3401 presses an inserted conductor 3403 against a contact conductor 3404 situated in the connector, in the closed state. The plastic section 3401 is situated against a softer plastic section 3402 in such a way that the latter is compressed by inserting a pin-like tool for opening, and automatically springs back when the tool is removed, thus providing automatic closing of the insertion opening.

Figure 35:
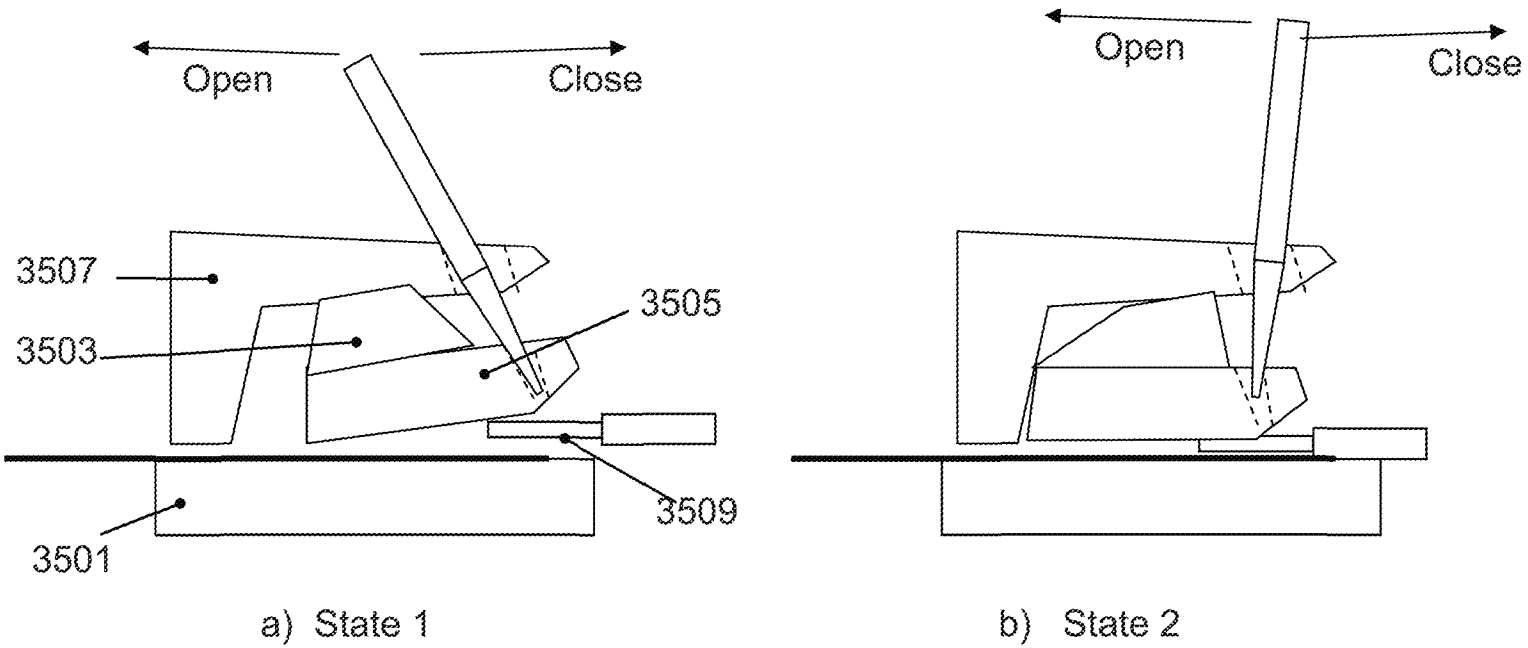
FIG. 35 shows a form of clamp.

FIG. 35 shows a form of clamp having a first section 3501, and a second section 3503 which is situated on a third section 3505. A section 3507 is also provided. Sections 3501, 3505, and 3507 are less elastic than section 3503. For clamping a conductor 3509 to be accommodated between the two harder sections 3501 and 3505, the clamp is opened by once again using a pin-like tool; the state transition is illustrated in FIGS. 35*a* and 35*b*. Use is made of the cam effect in the clamp illustrated in FIG. 35, as the result of which sections 3505 and 3507 connect more elastic section 3503, by means of which the two harder sections 3505 and 3507 are pushed against one another, and in the state according to FIG. 35*b* may once again be releasably locked. The reverse mounting of the apparatus (releasing and closing directions interchanged) would make the withdrawal more difficult.

Figure 36:
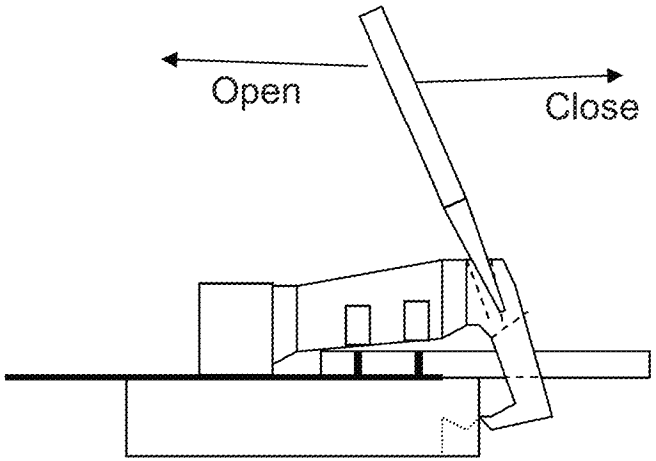
FIG. 36 shows a clamp.
Figure 36:
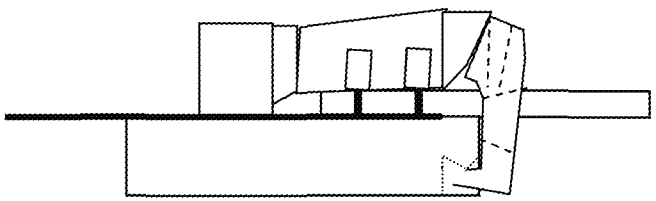
Figure 36:
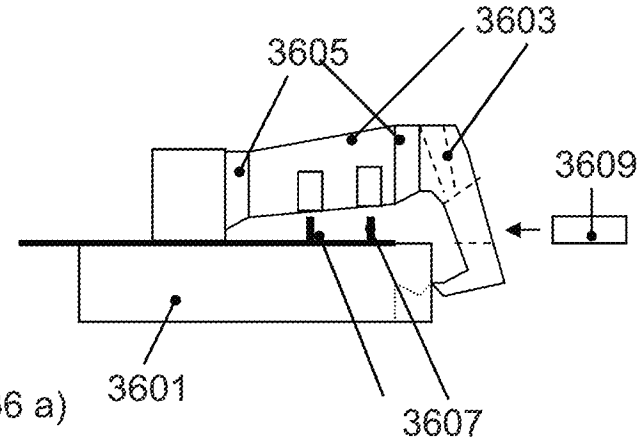
Figure 36:
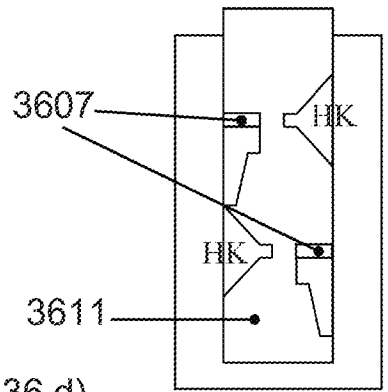

FIG. 36 shows a clamp having a first section 3601, which is formed from hard plastic, for example, and a movable second hard plastic section 3603 which may have elastic plastic portions 3605, for example. The clamp illustrated in FIG. 36 may be screwed in during manufacturing to produce a plug, or may be extrusion coated to produce a clamp. FIGS. 36*a*, 36*b*, and 36*c* illustrate, for example, the closing operation, using a pin-like actuator, from an open position without an inserted conductor 3609, to an open position in which an accommodated conductor 3609 is contacted using a cutting edge profile 3607, to a closed position in which the conductor is clamped between the harder sections 3601 and 3603. A molding for the movable section 3603 may accommodate the conductor 3609 so that the latter may be easily pulled from the cutting edge profile 3607 during release. FIG. 36*d* shows another view of such a clamp, in which "HK" denotes hard plastic. Section 3611 and the displacement elements may also be made of metal, for example, or manufactured using MID technology.

Figure 37B:
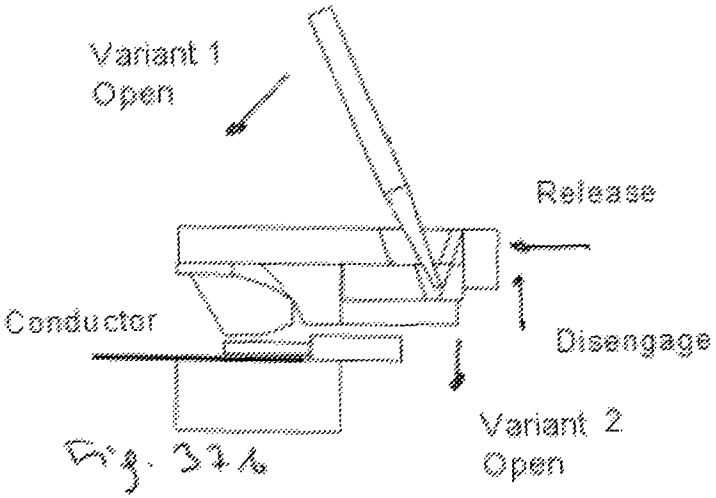
FIG. 37 shows an electrical connector.
Figure 37A:
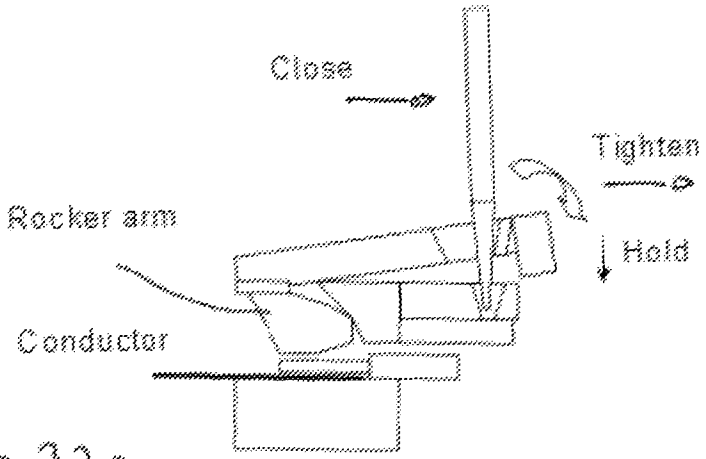

FIG. 37 shows an electrical connector which is opened using a pin as [illustrated] in FIGS. 37*a* and *b*.

FIG. 38 shows a further form of clamp, using soft plastic as embossing with hard plastic having thinner material. The clamp is connected to a printed circuit board 3801, and a terminating element 3803 for a conductive contact situated in the clamp may be produced from metal or conductive plastic with the aid of MID technology, for example. Release is performed using the elastic hard plastic 3805, and the contact pressure may be applied by a screw 3807, which in the front region is non-cutting and may thus be more satisfactorily molded by pressure, and which may have longitudinal grooves, for example, for fixation. A conductor 3809 inserted into the clamp may thus be securely locked, and pressed against the contact situated in the clamp.

Figure 39:
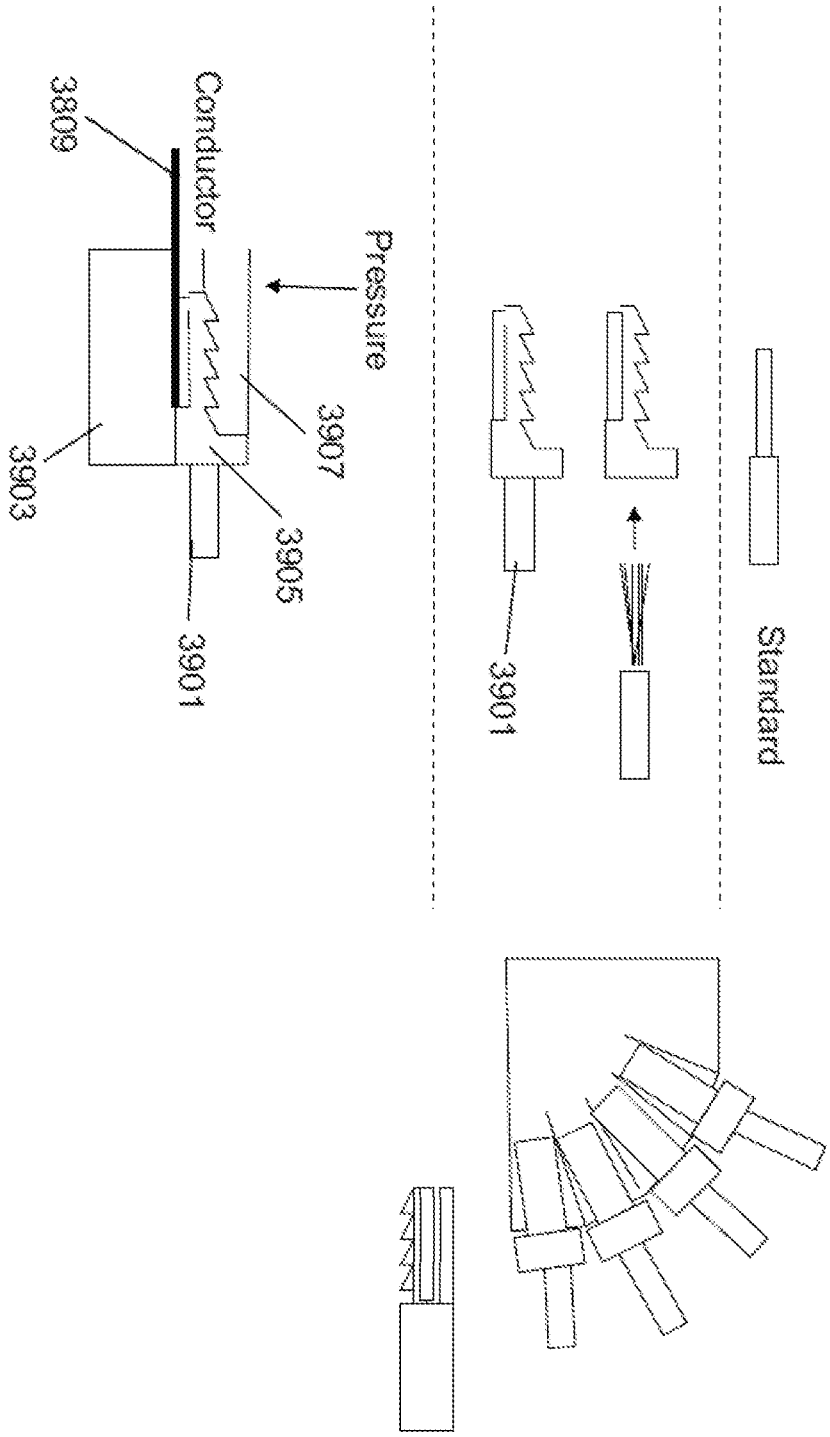
FIG. 39 shows a further form of clamp.

FIG. 39 shows a further form of clamp in which a cable end sleeve 3901 may be used as part of the clamp, for example. Various types of plastic sections 3903, 3905, and 3907 are also provided, a conductor 3909 being locked via teething of sections 3905 and 3907.

Figure 40:
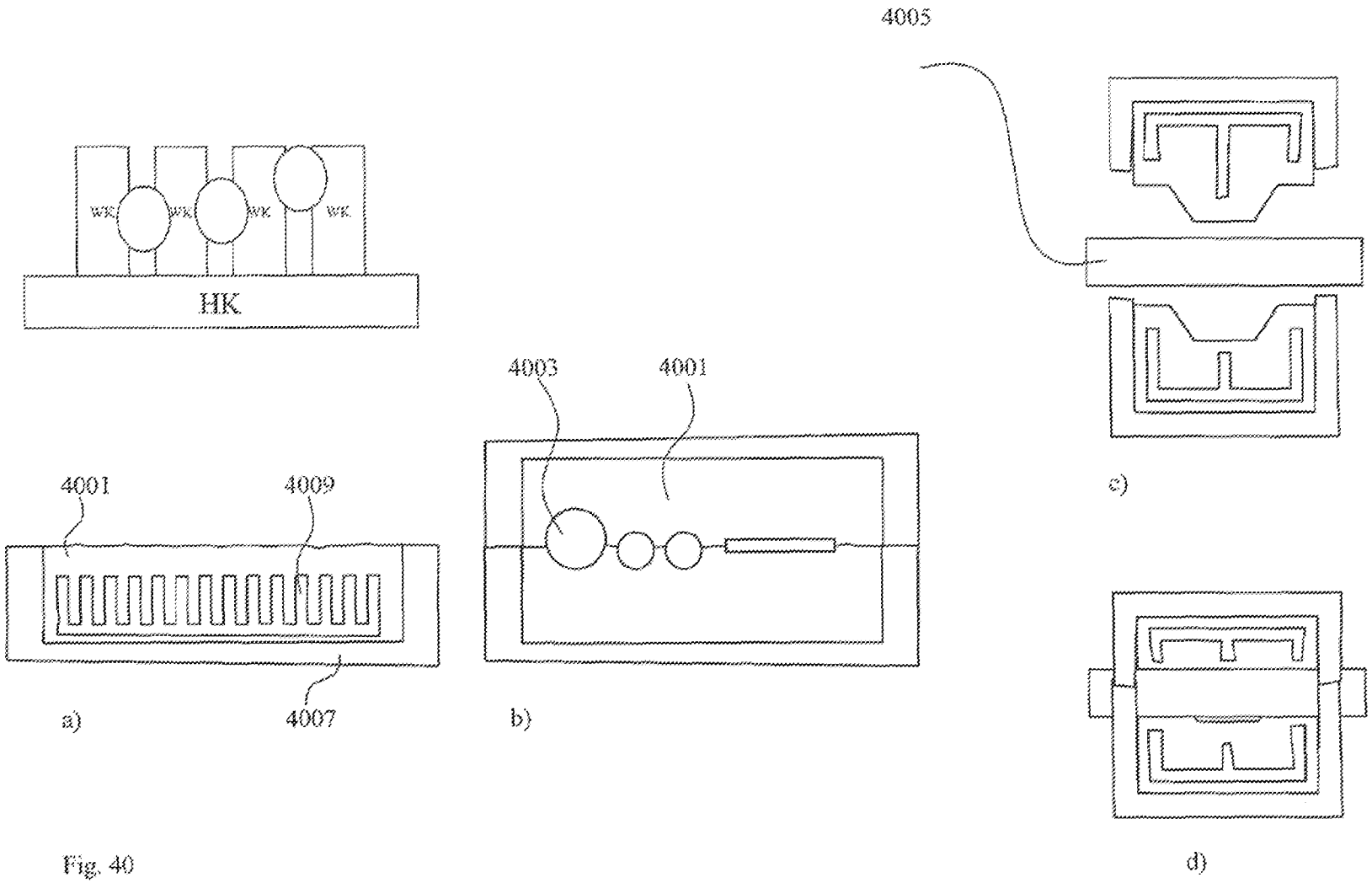
FIG. 40 shows a further form of clamp.

FIG. 40 shows further forms of clamps in which use is made of the so-called "assistance effect." The clamp includes a soft plastic 4001 which may be provided with stabilizers 4003, for example, which may be made of a harder plastic, for example, whereby a line piece 4005 is inserted and locked as illustrated in FIGS. 40*c* and 40*d*. Components made of hard plastic 4007 are provided, in addition to a comb-shaped section 4009 which may be made of an elastic plastic or a harder plastic.

The concept according to the invention allows the electrical connector, which may be designed as a clamp, for example, to be manufactured in an automated manner in the plastic injection molding process, whereby manufacturing methods known per se may be used for the introduction of metals, screws, or different plastics.

What is claimed is:

1. An electrical connector for accommodating an electrical conductor or mating connector, having:

a first plastic section having a first degree of hardness or elasticity;

a second plastic section having a second degree of hardness or elasticity; and a third plastic section having the first degree of hardness or elasticity;

wherein the first degree of hardness or elasticity and the second degree of hardness or elasticity are different, and the second section connects the first section and the third section, and the first section is displaceable or twistable relative to the third section with deformation of the second section, wherein the second section is provided for accommodating the electrical conductor or mating connector, and the first section imparts shape and at least partially envelops the second section.

2. The electrical connector according to claim 1, wherein the second section is reversibly deformable.

3. The electrical connector according to claim 1, wherein the first section or the second section is conductive.

4. The electrical connector according to claim 1, wherein the second section is elastically deformable, and the electrical conductor or mating connecter is accommodated by deforming the second section.

5. The electrical connector according to claim 1, wherein the first section may be locked and/or released from a lock, relative to the third section with deformation of the second section, or may be locked and/or released from a lock by displacement or twisting.

6. The electrical connector according to claim 1, wherein the first section may be inserted into the second section, and may be locked therein or released from a lock by elastic deformation of the first section or of the second section.

7. The electrical connector according to claim 1, wherein the first section may be twisted relative to the second section, or the second section may be twisted relative to the first section, wherein the first section or the second section may be locked or released from a lock by twisting.

8. The electrical connector according to claim 1, wherein the second degree of elasticity is greater than the first degree of elasticity, or the first degree of hardness is greater than the second degree of hardness.

9. The electrical connector according to claim 1, wherein the second section has comb-shaped regions for accommodating the electrical conductor or mating connector.

10. The electrical connector according to claim 1, wherein the second section is designed as an elastic clamping connector.

11. The electrical connector according to claim 1, wherein the first section may be clamped in a recess in the third section, and may be released as the result of a restoring force of the second section.

12. The electrical connector according to claim 1, wherein the first section and the third section are connected by the second section and form a clamp.

13. The electrical connector according to claim 1, wherein the third plastic section is displaceably supported with respect to the first section.

* * * * *

UNITED STATES PATENT AND TRADEMARK OFFICE

CERTIFICATE OF CORRECTION

PATENT NO. : 8,678,854 B2
APPLICATION NO. : 12/933353
DATED : March 25, 2014
INVENTOR(S) : Johannes Kalhoff It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 603 days.

Signed and Sealed this
Twenty-ninth Day of September, 2015

Michelle K. Lee

Michelle K. Lee
*Director of the United States Patent and Trademark Office*